US005503331A

United States Patent [19]

Urmson, Jr. et al.

[11] Patent Number: 5,503,331

[45] Date of Patent: Apr. 2, 1996

[54] INSULATED RAIL JOINT INCORPORATING SPACER-IMPREGNATED ADHESIVE AND METHOD FOR BONDING INSULATED RAIL JOINTS

[75] Inventors: William T. Urmson, Jr., Valencia, Pa.; John M. Downey, Ashland, Ky.; John W. Mospan, Pittsburgh, Pa.

[73] Assignee: Portec-RMP Division, Pittsburgh, Pa.

[21] Appl. No.: 246,596

[22] Filed: May 20, 1994

[51] Int. Cl.[6] ..... E01B 11/00

[52] U.S. Cl. ..... 238/152; 238/159

[58] Field of Search ..... 238/151, 152, 238/153, 159, 160, 161, 161.5, 168, 218, 243, 227; 174/117 R, 117 F, 117 FF; 156/91, 92, 276

[56] References Cited

U.S. PATENT DOCUMENTS

| | | | |
|---|---|---|---|
| 3,154,250 | 10/1964 | Lansing | 238/152 |
| 3,335,953 | 8/1967 | Hamilton, Jr. | 238/243 |
| 3,381,892 | 5/1968 | Eisses | 238/159 |
| 3,698,634 | 10/1972 | Hamilton, Jr. | 238/152 |
| 3,900,360 | 8/1975 | Leatherman | 156/276 |
| 3,948,185 | 4/1976 | Settle et al. | 104/9 |
| 3,952,948 | 4/1976 | Nelson et al. | 238/243 |
| 4,256,259 | 3/1981 | Gore | 238/160 |
| 4,273,052 | 6/1981 | Woolner et al. | 104/17 R |
| 4,273,284 | 6/1981 | Hannigan | 238/160 |
| 4,292,110 | 9/1981 | Marteness | 156/92 |
| 4,464,831 | 8/1984 | Weber et al. | 29/825 |
| 4,466,570 | 8/1984 | Howard | 238/153 |
| 4,545,840 | 10/1985 | Newman et al. | 156/276 |
| 4,630,772 | 12/1986 | Watanabe et al. | 238/159 |
| 4,773,590 | 9/1988 | Dash et al. | 238/153 |

FOREIGN PATENT DOCUMENTS

| | | |
|---|---|---|
| 46122 | 3/1974 | Australia . |
| 2009175 | 2/1970 | Germany . |
| 2115402 | 4/1990 | Japan . |
| 7315366 | 11/1973 | Netherlands . |
| 2071187 | 9/1981 | United Kingdom . |

*Primary Examiner*—Mark T. Le

*Attorney, Agent, or Firm*—Webb Ziesenheim Bruening Logsdon Orkin & Hanson

[57] ABSTRACT

The present invention generally relates to a railway or railroad track joint, and more particularly, to an improved electrically insulated bonded rail joint incorporating a non-conductive spacer in or associated with a rail bonding adhesive. The present invention also relates to a method for bonding such electrically insulated rail joints. The present invention provides more control over the spacing of the adhesive layer to achieve a stronger joint and more predictable and stable electrical insulation of a track circuit with improved bonding.

12 Claims, 1 Drawing Sheet

INSULATED RAIL JOINT INCORPORATING SPACER-IMPREGNATED ADHESIVE AND METHOD FOR BONDING INSULATED RAIL JOINTS

BACKGROUND OF THE INVENTION

1. Field of the Invention

The present invention generally relates to a railway or railroad track joint, and more particularly, to an improved electrically insulated bonded rail joint incorporating a non-conductive spacer in or associated with a rail bonding adhesive. The present invention also relates to a method for bonding such electrically insulated rail joints. The present invention provides more control over the spacing of the adhesive layer to achieve a stronger joint and a more predictable and stable electrical insulation of a track circuit with improved bonding.

2. Description of the Prior Art

Joining of two railroad rails has had quite a varied history. Originally, two rail ends were butted together, and "bars" or "fishplates" generally about three feet long, were used as scabs across the rail joint, one inside and one outside of the rail. The "bars" or "fishplates" and the rails were drilled to accept bolts, which once inserted and tightened, held the rails and fishplates together as one piece.

One limitation associated with joining two rails in this manner is that there is metal-to-metal contact between the rails and the fishplates, which results in rail joints that are not electrically insulated from each other. Electrical insulation between adjoining rails is desired in some applications within the rail industry. For example, where rails are electrically insulated from their adjoining rails, the metal wheels or trucks of a train or similar railed vehicle crossing the insulated rails can be used to complete an electrical circuit. The completed electrical circuit is used in many applications, such as triggering signalling devices further down the track, moving switches, or sending computer signals to locate the train on the track for a central dispatcher.

The first attempts to electrically insulate rail joints simply consisted of a flexible, formed, durable insulating material inserted between the fishplates and the rails, and between the butted rail ends. However, this is far from the present state of the art.

The second stage in the evolution of the development of electrically insulated rail joints, provided for embedding the metal fishplates within an insulating shielding material. Most commonly polyurethane is chosen as the insulating material for this application.

The third stage in the evolution of the development or the rail joints was the formation of "bonded" railroad rail joints. With bonded railroad rail joints, a rail bonding adhesive, typically an epoxy material, is used to chemically glue or bond the fishplates and rails together as one unit. Additionally, in some applications, a web-like or matting material is inserted between the fishplates and the rails which is coated on one or both sides with rail bonding adhesive. The bonded rail joint is typically the strongest rail joint and is a very solid rail joining means. Bonded rail joints prevent movement of one bonded rail relative to the other bonded rail. While bolts similar to those described above are still used in this application, the bolts function mainly as a press to hold the rail bonding adhesive, the fishplates and the rails together until the adhesive sets and forms the bond.

With the bonded railroad rail joints discussed above, to form an electrically insulated as well as a bonded rail joint, two rail ends are butted with an insulating material inserted therebetween. The insulating material between the rail ends is often called an "end post". Further, the vertical surfaces of the rails are coated on the inside and outside with a layer of rail bonding adhesive for a distance of about 1.5 feet on both sides of the point where the rail ends abut the insulating material. "Inside" and "outside" means here with respect to the track itself as though the rail was installed on a track bed, with "inside" denoting the rail surface between the rails and "outside" denoting the surface of the rail opposite the "inside" surface. In some applications, a layer of matting material, which is typically made of fiberglass and is on the order of 1/16 inch thick and is quite shapable, is laid on top of the rail bonding adhesive layer. The matting material layer is in turn covered with another layer of rail bonding adhesive. The rail bonding adhesive soaks through the matting layer. Subsequently, metal fishplates are placed on the inside and outside of the rails and bolts (usually 4–6) are installed horizontally (with respect to the track bed) through the two fishplates and the rails. The tightening of the bolts holds the fishplates, rail bonding adhesive and rails together as one unit while the rail bonding adhesive sets. The rail bonding adhesive can cure at ambient temperatures or at elevated temperatures. The resulting rail joint bond is quite strong and electrically insulated.

A limitation of the bonded/insulated rail joint is that the process of tightening the nuts on the bolts squeezes out all or nearly all of the rail bonding adhesive and crushes the matting material layer, resulting in a very thin adhesive layer in the rail bonding joint. This results in a weaker bonded rail joint and less electrical insulating capability.

Attempts have been made in the prior art to provide a spacer between the fishplates and the rails to prevent the formation of an unacceptably thin adhesive layer in the rail bonding joint. U.S. Pat. No. 3,381,892 to Eisses discloses a rail joint construction which includes an insulating layer comprising a cold hardening paste layer 6 which is surrounded by nylon rods 9 and 10. The nylon rods 9 and 10 serve as spacing elements spacing the fishplates 3 and 4 from the rails 1 and 2.

British Patent No. 2,071,187 discloses an insulated rail joint comprising a fishplate of insulating material having a series of vertical ribs spaced along its rail engaging faces. The plastic material of the fishplate may include abrasive-proof grains suspended within the plastic. The abrasive-proof grains are apparently intended to increase the frictional engagement of the ribs with the rail and do not perform a spacing function.

However, none of the prior art references discloses a bonded rail joint or method of making a bonded rail joint wherein the thickness of the rail bonding adhesive layer and the corresponding degree of electrical insulation can be easily modified at will to provide a bonded rail joint of a desired thickness and electrical insulating capability. Thus, a need exits in the prior art for a bonded rail joint and for a method of making a bonded rail joint wherein the thickness of the adhesive layer in the bonded rail joint can be easily and reliably modified at will to provide a rail joint having an adhesive layer of a desired thickness and insulating capability whether manufactured under factory or field conditions.

SUMMARY OF THE INVENTION

The present inventors have found that a rail bonding adhesive having non-conductive spacers embedded therein provides control over the final thickness of the rail bonding adhesive layer and, hence, the electrical insulating capabilities of the bonded rail joint. Non-conductive glass bead-like spacers are preferred. Advantages of a bonded/insulated rail joint employing a rail bonding adhesive in which non-conductive spacers are embedded include:

a) differently sized spacers (or separating material) can be used for different applications (cold weather, hot weather tracks etc);

b) varying the non-conductive spacer size or diameter results in varying the depth or thickness of the bonded rail adhesive joint;

c) varying the non-conductive spacer concentration within the rail bonding adhesive permits varying the ratio of adhesive/non-conductive spacers providing for more control over the strength and cost of producing the bonded rail joint; and d) the non-conductive spacers can be either non-coated or coated with a substance which increases the adhesion between the non-conductive spacers and the rail bonding adhesive to further strengthen the bond.

In one embodiment of the present invention, a series of rail bonding adhesives can be pre-manufactured embedded with various non-conductive spacer sizes and concentrations for varying conditions and requirements. The non-conductive spacers pre-embedded within the rail bonding adhesive itself is an advantage where the rail joint is assembled at the track bed work site as opposed to being preassembled at the factory and then installed at the track bed work site.

In an alternative embodiment, the non-conductive spacers are provided separately from the rail bonding adhesive. The non-conductive spacers are then mixed with the rail bonding adhesive immediately before applying the adhesive either at the factory or the work site or are coated as a layer on top of an applied layer of rail bonding adhesive. This permits selection of various sizes and concentrations of non-conductive spacers for varying conditions and requirements.

A complete understanding of the invention will be obtained from the following description when taken in connection with the accompanying drawing figures wherein like reference characters identify like parts throughout.

DESCRIPTION OF THE PREFERRED EMBODIMENTS

Figure 1:
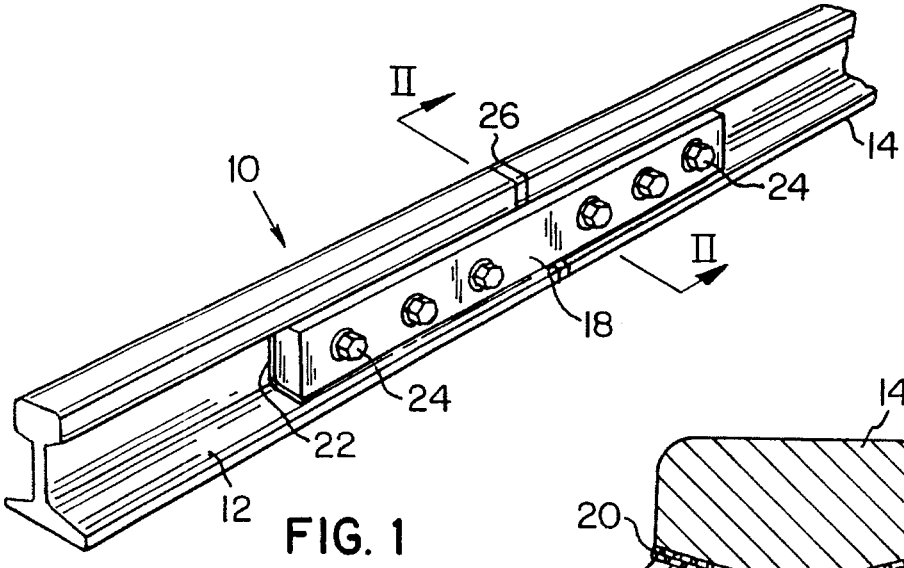
FIG. 1 is a perspective view of a pair of adjacent rail sections and a bonded electrically insulated rail joint which is the subject of this invention.

Referring to the drawings and particularly to FIG. 1, there is illustrated a bonded electrically insulated rail joint generally designated by the numeral 10 for bonding and electrically insulating a pair of adjacent rail sections 12 and 14. Rail joint 10 electrically insulates electrical signals present on adjacent rail sections to insure proper railroad signal system operation. Rail joint 10 eliminates the problems associated with short circuited adjacent rail sections and the resultant signal system errors.

Figure 3:
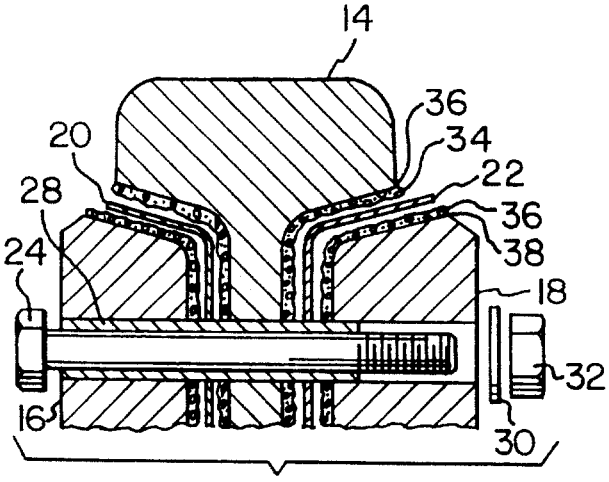
FIG. 3 is an enlarged portion of the rail joint shown in FIG. 2.
Figure 4:
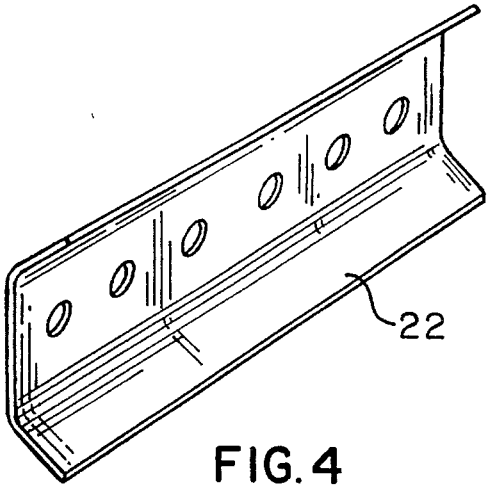
FIG. 4 is a perspective view of a matting material layer of the rail joint according to the present invention.

FIG. 1 illustrates the rail joint 10 positioned between first rail section 12 and second rail section 14. Rail joint 10 bonds rail sections 12 and 14 to each other while electrically insulating electrical signals present on rail section 12 from electrical signals present on rail section 14. Connecting bars or fishplates 16 and 18 are also shown in the drawings. Fishplates 16 and 18 are also referred to commonly in the railroad industry as "splice bars" or "joint bars". A matting material layer 20 extends partially around fishplate 16 and, similarly, a matting material layer 22 extends partially around fishplate 18. Matting material layer 22 is shown in FIG. 4. Matting material layers 20 and 22 are each coated with a rail bonding adhesive as discussed in detail below in connection with FIG. 3. A plurality of bolts 24 rigidly connects fishplate 16 and fishplate 18 to rail sections 12 and 14.

Figure 2:
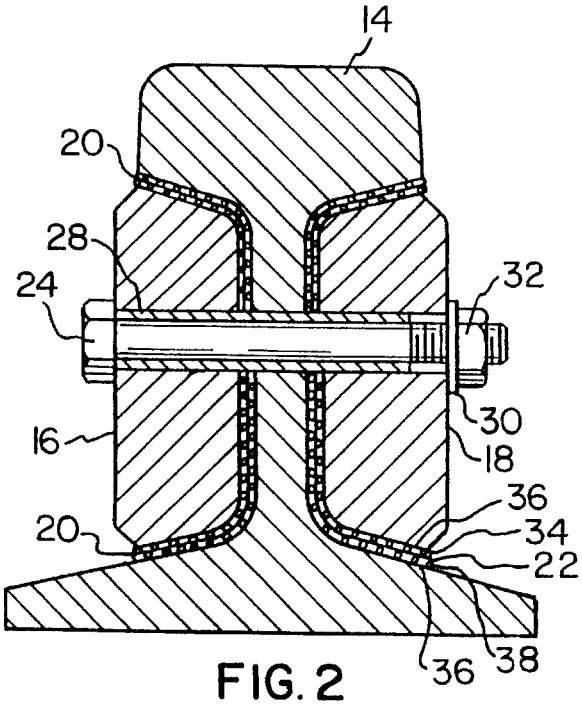
FIG. 2 is a cross section on line II—II in FIG. 1.
Figure 5:
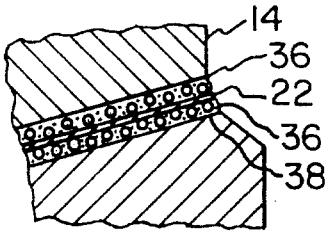
FIG. 5 is an enlarged section of a portion the rail joint shown in FIG. 2 showing the compression of the rail joint in detail.

As shown in FIG. 1, an electrically insulating spacer 26 is interposed between the ends of rail sections 12 and 14. As shown in FIG. 2, holes punched into the matting material layers 20 and 22 receive bolts 24 and insulated bushings 28. The bolts 24 must be at least partially surrounded by insulating bushings 28 as shown in FIGS. 2 and 3 to prevent the bolt from conducting electric current between the rail sections and the fishplates and thereby assuring electrical insulation of the rail joint. Washer 30 and nut 32 complete the mechanical assembly of the rail joint.

FIG. 3 is an enlarged section view of a portion of rail joint 10. Only the rail 14, shown bonded with fishplates 16 and 18, will be discussed for brevity of discussion, but the rail joint between fishplates 16 and 18 and rail sections 12 and 14 is similarly formed. Matting material layer 22 is interposed between rail section 14 and fishplate 18. A first layer of rail bonding adhesive 34 is interposed between matting material layer 22 and rail section 14. A plurality of non-conductive spacers is embedded within the first layer of rail bonding adhesive 34. A second layer of rail bonding adhesive 38 is shown in FIG. 3 interposed between matting material layer 22 and fishplate 18. Again, a plurality of non-conductive spacers 36 is embedded in the second layer of rail bonding adhesive 38 in FIG. 3.

While spacers of any symmetrical geometric configuration will work with the present invention, spherical or bead-like spacers are the preferred embodiment. As shown in FIG. 4, after compression of the rail joint by the tightening of nuts 32 on bolts 24, non-conductive spacers 36 maintain the proper spacing between fishplates 16 and 18 and rail section 14 despite any deformation or crushing of matting material layer 22 during the compression process.

Generally, the non-conductive spacers are between 20–40/1000 of an inch in diameter and are present in a concentration by weight of rail bonding adhesive on the order of 20–40%. While a range of diameters is within the scope of the present invention, it should be noted that too small a non-conductive spacer diameter will result in a rail bonding adhesive layer which is too thin and, therefore, not strong enough and/or will not possess sufficient electrical insulating capabilities. At the other extreme, too large a non-conductive spacer diameter will result in a rail bonding adhesive layer which is also not strong enough and/or will result in wasting needless rail bonding adhesive. Similarly, a low concentration of non-conductive spacers will not insure uniform and predictable spacing. At the other extreme, too high a concentration of non-conductive spacers will result in an insufficient amount of rail bonding adhesive in the rail joint which can lead to a weak joint and/or to premature joint failure.

The rail bonding adhesive 34,38 can be any of the types well known in the art. Similarly, matting material layer 22 can be any of the types well known in the art, such as fiberglass matting material.

In the preferred embodiment of the invention, non-conductive spacers 36 are embedded in the rail bonding adhesive before it is applied to the rail joint. In this embodiment, several rail bonding adhesive formulations can be developed with non-conductive spacers of varying sizes and concentrations to yield rail bonding joints of various thicknesses and insulating capabilities as required or desired for various applications.

Alternatively, the non-conductive spacers can be mixed with rail bonding adhesive at the factory or the track work site by the craftsperson forming the bonded rail joint. In this embodiment of the present invention, the craftsperson needs only non-conductive spacers of various diameters and can modify concentrations of a given diameter of non-conductive spacers in the rail bonding adhesive as required or desired.

In an alternative embodiment of the present invention, a first layer of rail bonding adhesive 34 is applied to rail section 14. The first layer of rail bonding adhesive 34 is then covered with a plurality of non-conductive spacers 36. Matting material layer 22 is then placed over first layer of rail bonding adhesive 34. A second layer of rail bonding adhesive 38 is applied to the exposed surface of matting material layer 22 and a second layer of rail bonding adhesive 38 is coated with a plurality of non-conductive spacers 36. Fishplate 18 is then placed, over the rail joint along with fishplate 16, with an identical rail bonding adhesive layer configuration having been applied to the opposite face of rail section 14. When nut 32 is tightened on bolt 24, non-conductive spacers 36 prevent the collapse of the matting material layer 22 and space rail section 14 and fishplate 18 apart according to the diameter of the non-conductive spacers 36. Similar spacing is achieved when the embodiment shown in FIG. 3 is applied to fishplate 16 and the interface between rail section 12 and fishplates 16 and 18.

In still another embodiment of the present invention, non-conductive spacers 36 can be coated with a layer of a substance such as, for example, a saline solution which increases adhesion between the nonconductive spacers and the rail bonding adhesive to further strengthen the formed bond.

The present invention permits reliably reproducing adhesive joints of a given thickness, which in turn results in reliably reproducible electrical insulating qualities.

While the embodiments of the subject invention have been described and illustrated, it is obvious that various changes and modifications can be made therein without departing from the spirit of the present invention which should be limited only by the scope of the appended claims.

What is claimed is:

1. An electrically insulating joint for connecting a pair of adjacent rail sections positioned in end-to-end relation and being separated to provide a space therebetween, said joint comprising:

an electrically insulating means disposed in said space between said rail ends, said insulating means having substantially the same cross-sectional configuration as said rail sections;

a pair of fishplates disposed in parallel relation along said adjacent rail sections with said rail sections being disposed between said pair of fishplates, said fishplates bridging said adjacent rail sections and said electrically insulating means;

a first layer of rail bonding adhesive disposed on said rail sections between said rail sections and said fishplates;

a plurality of non-conductive bead-like spacers dispersed in said rail bonding adhesive;

a layer of matting material disposed on said first layer of rail bonding adhesive;

a second layer of rail bonding adhesive disposed on said layer of matting material;

a plurality of non-conductive bead-like spacers dispersed in said second layer of rail bonding adhesive;

a plurality of series of aligned holes formed in said fishplates, said matting material, said adhesive layers and said rail sections and an electrically insulating bushing located in each series of aligned holes; and a bolt having a threaded end extending through each of said bushings and a washer and nut assembly threaded on said bolt, whereby tightening said nut on said bolt urges said fishplates together to rigidly join said rail sections while said rail bonding adhesive cures.

2. A joint as described in claim 1 wherein said non-conductive bead-like spacers are geometrically shaped.

3. A joint as described in claim 1 wherein said non-conductive bead-like spacers are spherical.

4. A joint as described in claim 1 wherein said non-conductive bead-like spacers are glass beads.

5. A joint as described in claim 1 wherein said non-conductive bead-like spacers are between 20 thousandths to 40 thousandths of an inch in diameter.

6. A joint as described in claim 1 wherein said non-conductive bead-like spacers are present in a concentration by weight of rail bonding adhesive of 20–40%.

7. A joint as described in claim 1 wherein said matting material layer is comprised of fiberglass.

8. A joint as described in claim 1 wherein at least a portion of said non-conductive bead-like spacers are coated with a layer of a material which increases adhesion between said non-conductive spacers and said rail bonding adhesive.

9. A joint as described in claim 8 wherein said layer of material is a saline solution.

10. An electrically insulating joint for connecting the spaced ends of a pair of adjacent rail sections, said joint including:

an electrically insulating means disposed in said space between said spaced ends of said adjacent rail ends, said insulating means having substantially the same cross-sectional configuration as said rail sections;

a pair of fishplates disposed in parallel relation along said adjacent rail sections with said rail sections being disposed between said pair of fishplates, said fishplates bridging said adjacent rail sections and said electrically insulating means;

a first layer of rail bonding adhesive disposed on said rail sections between said rail sections and said fishplates;

a first layer of non-conductive bead-like spacers disposed on said first layer of rail bonding adhesive;

a layer of matting material disposed on said first layer of non-conductive spacers;

a second layer of rail bonding adhesive disposed on said layer of matting material;

a second layer of non-conductive bead-like spacers disposed on said second layer of rail bonding adhesive;

a plurality of series of aligned holes extending through said fishplates, said matting material, said layers of spacers and rail bonding adhesive and said rail sections; and an electrically insulating bushing in each of said series of aligned holes, a bolt having a threaded end in each of said bushings and a washer and nut assembly threaded on said bolt, whereby tightening nut on said bolt urges said fishplates together to rigidly join said rail sections while said rail bonding adhesive cures.

11. A method of forming an electrically insulated bonded rail joint comprising:

positioning a pair of adjacent rail sections in end-to-end longitudinally spaced relation;

disposing an electrically insulating means having substantially the same cross-sectional configuration as said rail sections in said space between said adjacent rail ends;

positioning a pair of fishplates in parallel relation along said adjacent rail sections with said rail sections being disposed between said pair of fishplates, said fishplates bridging said adjacent rail sections and said electrically insulating means located therebetween;

coating a first layer of rail bonding adhesive including a plurality of non-conductive bead-like spacers on said rail sections in spaces defined between said rail sections and said fishplates;

positioning a layer of matting material on said first layer of rail bonding adhesive;

coating a second layer of rail bonding adhesive including a plurality of non-conductive bead-like spacers on said layer of matting material;

providing a series of aligned holes through said fishplates, said matting material, said adhesive layers and said rail sections;

inserting an electrically insulating bushing in each of said holes; and inserting a bolt having a threaded end in each of said bushings, and tightening a nut on said threaded end of each of said bolts to urge said fishplates together to rigidly join said rail sections while said rail bonding adhesive cures.

12. A method of forming an electrically insulated bonded rail joint comprising:

positioning a pair of adjacent rail sections in end-to-end spaced relation;

disposing an electrically insulating means having substantially the same cross-sectional configuration as said rail sections in said space between said adjacent rail ends;

positioning a pair of fishplates in parallel relation along said adjacent rail sections with said rail sections being disposed between said pair of fishplates, said fishplates bridging said adjacent rail sections and said electrically insulating means located therebetween;

coating a first layer of rail bonding adhesive on said rail sections in spaces defined between said rail sections and said fishplates;

coating a first layer of non-conductive bead-like spacers on said first layer of rail bonding adhesive;

positioning a layer of matting material on said first layer of non-conductive spacers;

coating a second layer of rail bonding adhesive on said layer of matting material;

coating a second layer of non-conductive bead-like spacers on said second layer of rail bonding adhesive;

providing a series of aligned holes through said fishplates, said matting material, said layers of adhesive and spacers and said rail sections;

locating an electrically insulating bushing in each of said series of aligned holes; and inserting a bolt having a threaded end in each of said bushings, and tightening a nut on said threaded end of each of said bolts to urge said fishplates together to rigidly join said rail sections while said rail bonding adhesive cures.

* * * * *

UNITED STATES PATENT AND TRADEMARK OFFICE

CERTIFICATE OF CORRECTION

PATENT NO. : 5,503,331

DATED : April 2, 1996

INVENTOR(S) : William T. Urmson, Jr., John M. Downey and John W. Mospan

It is certified that error appears in the above-indentified patent and that said Letters Patent is hereby corrected as shown below:

Column 1 Line 47 after "joints" delete ",".

Column 3 Line 8 "tracks etc);" should read --tracks, etc.);--.

Column 3 Line 53 "portion the" should read --portion of the--.

Column 5 Line 42 "nonconductive" should read --non-conductive--.

Signed and Sealed this

Twenty-seventh Day of August, 1996

*Attest:*

Bruce Lehman

BRUCE LEHMAN

*Attesting Officer*

*Commissioner of Patents and Trademarks*